US010900472B1

(12) United States Patent
Bonny

(10) Patent No.: US 10,900,472 B1
(45) Date of Patent: Jan. 26, 2021

(54) PRESSURE COMPENSATING PUMP

(71) Applicant: Hydro-Gear Limited Partnership, Sullivan, IL (US)

(72) Inventor: Nathan W. Bonny, Shelbyville, IL (US)

(73) Assignee: Hydro-Gear Limited Partnership, Sullivan, IL (US)

( * ) Notice: Subject to any disclaimer, the term of this patent is extended or adjusted under 35 U.S.C. 154(b) by 431 days.

(21) Appl. No.: 15/697,108

(22) Filed: Sep. 6, 2017

Related U.S. Application Data

(60) Provisional application No. 62/482,019, filed on Apr. 5, 2017, provisional application No. 62/395,789, filed on Sep. 16, 2016.

(51) Int. Cl.

| | |
|---|---|
| ***F04B 1/324*** | (2020.01) |
| ***F04B 1/2078*** | (2020.01) |
| ***F01B 13/04*** | (2006.01) |
| ***F04B 1/20*** | (2020.01) |
| ***F01B 13/06*** | (2006.01) |
| ***F04B 1/12*** | (2020.01) |
| ***F04B 1/2042*** | (2020.01) |

(52) U.S. Cl.
CPC ..... *F04B 1/324* (2013.01); *F01B 13/04* (2013.01); *F01B 13/06* (2013.01); *F04B 1/12* (2013.01); *F04B 1/20* (2013.01); *F04B 1/2042* (2013.01); *F04B 1/2078* (2013.01)

(58) Field of Classification Search
CPC .. F04B 1/29; F04B 1/295; F04B 1/324; F04B 1/2078; F04B 13/04; F04B 1/2042; F04B 1/12; F04B 1/20; F04B 1/0452; F04B 1/0465; F01B 13/06
See application file for complete search history.

(56) References Cited

U.S. PATENT DOCUMENTS 1,172,412 A 2/1916 Saalfeld
2,633,104 A * 3/1953 Lauck ..... F01B 3/0047 91/505
4,043,419 A 8/1977 Larson et al.
(Continued)

FOREIGN PATENT DOCUMENTS

JP S5238605 A * 3/1977 ..... F04B 1/20

OTHER PUBLICATIONS

Danfoss Technical Information Booklet, General, Steering Components, Rev. 0400, Sep. 2015.
(Continued)

*Primary Examiner* — Philip E Stimpert
(74) *Attorney, Agent, or Firm* — Neal, Gerber & Eisenberg LLP

(57) ABSTRACT

A hydraulic pressure compensating pump assembly having a fluid flow regulation mechanism is provided. The fluid flow regulation mechanism is set to an initial stroked position that can be adjusted to accommodate various applications. The fluid flow regulation mechanism includes a biasing means that allows the pump to de-stroke in response to a pressure demand increase and to return to the initial pressure set point when pressure demand subsides sufficiently. Different spring types and spring rates can be specified to achieve a desired response to pressure demand fluctuations within a particular hydraulic circuit.

14 Claims, 14 Drawing Sheets

(56) References Cited

U.S. PATENT DOCUMENTS

| | | | | |
|---|---|---|---|---|
| 4,550,645 | A * | 11/1985 | Beck, Jr. | F04B 1/2042 29/888.02 |
| 6,332,393 | B1 | 12/2001 | Trimble | |
| 6,487,857 | B1 * | 12/2002 | Poplawski | F01B 13/04 60/487 |
| 6,701,825 | B1 | 3/2004 | Langenfeld | |
| 6,782,797 | B1 | 8/2004 | Brandenburg et al. | |
| 6,964,164 | B1 | 11/2005 | Langenfeld | |
| 6,986,363 | B1 | 1/2006 | Trimble et al. | |
| 7,197,873 | B1 | 4/2007 | Windhorst et al. | |
| 8,001,883 | B1 * | 8/2011 | Langenfeld | F16H 61/437 92/12.2 |
| 8,459,137 | B1 | 6/2013 | McCoy et al. | |
| 9,341,258 | B1 | 5/2016 | Templin | |
| 9,657,726 | B1 | 5/2017 | Bonny | |

OTHER PUBLICATIONS

Danfoss Technical Information Booklet, Steering, OSPM Mini-Steering Unit, Mar. 2016.

* cited by examiner

PRESSURE COMPENSATING PUMP

CROSS-REFERENCE

This application claims the benefit of U.S. Provisional Pat. App. No. 62/482,019 filed on Apr. 5, 2017, and U.S. Provisional Pat. App. No. 62/395,789 filed on Sep. 16, 2016. Both of these prior applications are incorporated by reference herein in their entirety.

BACKGROUND OF THE INVENTION

This application relates to hydraulic systems generally and in particular to a pressure compensating pump utilizing a mechanical fluid flow regulation mechanism. One application is in utility vehicles. Some utility vehicle hydraulic systems benefit from pressure compensation to prevent excessive power drain from a prime mover when certain functions of the hydraulic system are active. In a utility vehicle, for example, a pressure compensating pump can be used to maintain approximately level fluid power to an auxiliary function of the vehicle when the auxiliary function is active. A pressure compensating pump having a simple mechanism for setting a desired pressure limit and providing automatic regulation of flow output to accommodate the varying demands of such a hydraulic system function is desirable.

SUMMARY

An improved pressure compensating pump having a relatively simple, low cost, mechanical fluid flow regulation mechanism with an adjustable pressure set point to accommodate various hydraulic system applications is disclosed herein. Typical applications for the described invention may include use as an open loop charge pump for a larger hydraulic circuit or use in an auxiliary circuit such as a power steering circuit that may require a standby pressure. Another application may include use in conjunction with a hydraulic cylinder wherein decreased fluid flow and reduced speed near the limit of extension of the hydraulic cylinder is desirable in order to prevent damage.

A better understanding of the disclosure will be obtained from the following detailed descriptions and accompanying drawings, which set forth illustrative embodiments indicative of the various ways in which the principals of the invention may be employed.

DETAILED DESCRIPTION OF THE DRAWINGS

Figure 1:
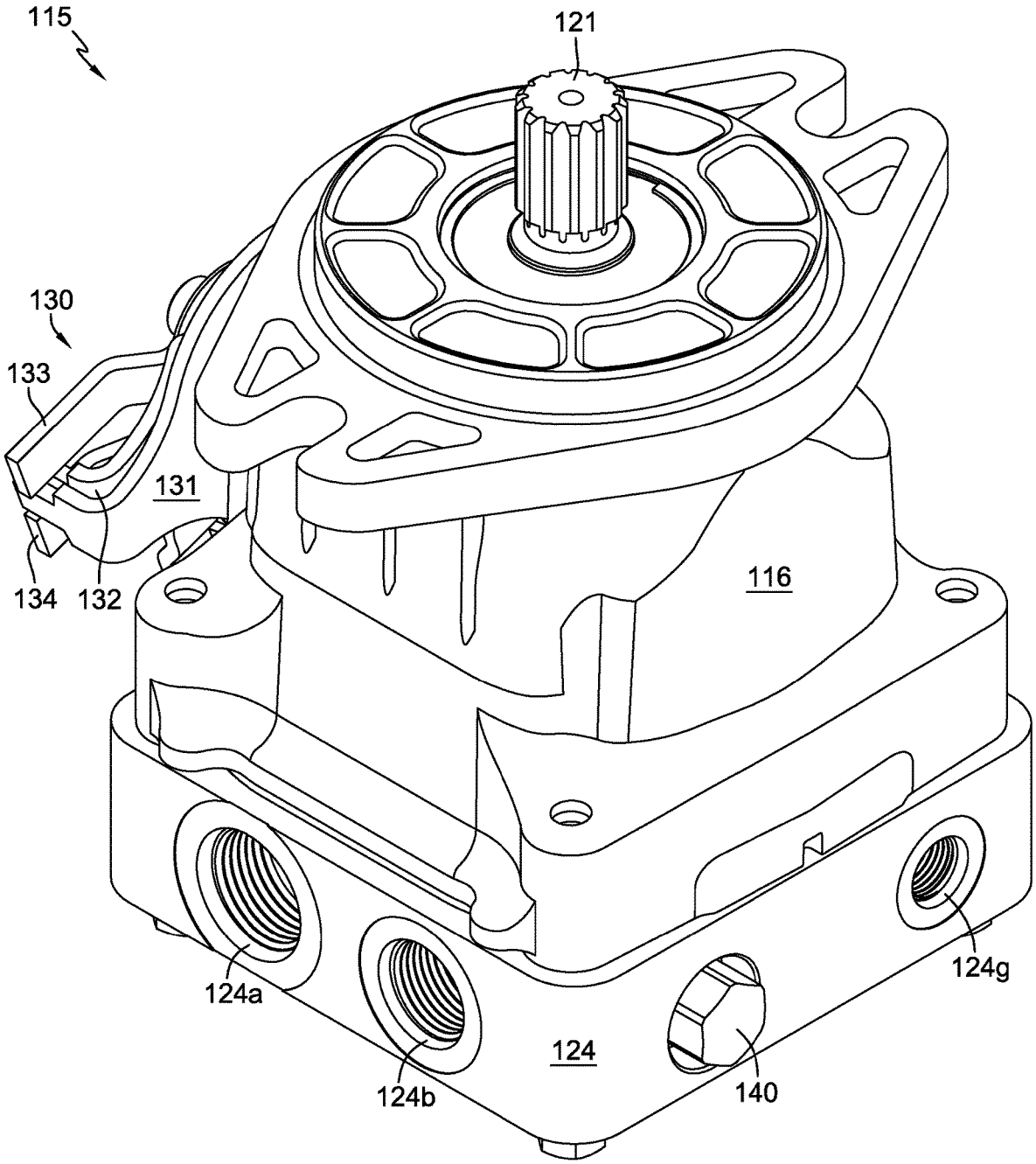
FIG. 1 is a perspective view of a first embodiment of a pressure compensating pump assembly.

The description that follows describes, illustrates and exemplifies one or more embodiments of the invention in accordance with its principles. This description is not provided to limit the invention to the embodiment(s) described herein, but rather to explain and teach the principles of the invention in order to enable one of ordinary skill in the art to understand these principles and, with that understanding, be able to apply them to practice not only the embodiment(s) described herein, but also any other embodiment that may come to mind in accordance with these principles. The scope of this disclosure is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers or serial numbers in cases where such labeling facilitates a more clear description. Additionally, the drawings set forth herein are not necessarily drawn to scale, and in some instances proportions may have been exaggerated to more clearly depict certain features. This specification is intended to be taken as a whole and interpreted in accordance with the principles of the disclosure as taught herein and understood by one of ordinary skill in the art.

FIGS. 1-9 illustrate a first embodiment of a pressure compensating pump assembly 115. Pump assembly 115 is similar in form but differs in certain functional and design aspects from that disclosed in commonly-owned U.S. Pat. No. 6,332,393, the terms of which are incorporated herein by reference. In general, pump assembly 115 is a variable displacement pump assembly comprising a housing 116 that forms a sump 170 (shown schematically in FIG. 10) when sealed by end cap 124. Pump assembly 115 includes an axial piston pump 120 that is disposed in sump 170 and is driven by an input shaft 121. In a typical application, input shaft 121 is driven by a prime mover (not shown), such as an internal combustion engine or electric motor, by means of a shaft coupled to input shaft 121 or by means of a pulley and belt arrangement. In such an application, pump assembly 115 may be continuously driven so that pressure is instantly available (standby pressure) or selectively engaged, via clutch, for example, when a particular auxiliary function is needed.

Axial piston pump 120 includes a cylinder block 122 that is rotated by input shaft 121 on running surface 124*e* of end cap 124, and is thus hydraulically connected to inlet kidney port 124*c* and outlet kidney port 124*d* formed in end cap 124. Cylinder block 122 accommodates a set of pistons 123 that ride on a thrust bearing 127 contained in a swash plate 126. In a conventional axial piston pump, such as that disclosed in U.S. Pat. No. 6,332,393, the displacement of the axial piston pump is controlled by rotation of a trunnion arm of similar or same design as trunnion arm 125 engaged to swash plate 126, and the fluid flow into and out of the end cap is bi-directional. In the current disclosure, displacement of the axial piston pump controls rotation of the trunnion arm and there is only one direction of fluid flow through end cap 124. Fluid flow is automatically regulated, based on fluid pressure demand, by a fluid flow regulation mechanism 130. The fluid flow regulation mechanism 130 may also be referred to herein as a return-to-stroke mechanism 130 or simply RTS 130. This mechanism will be described in greater detail herein following a description of the pump.

Figure 2:
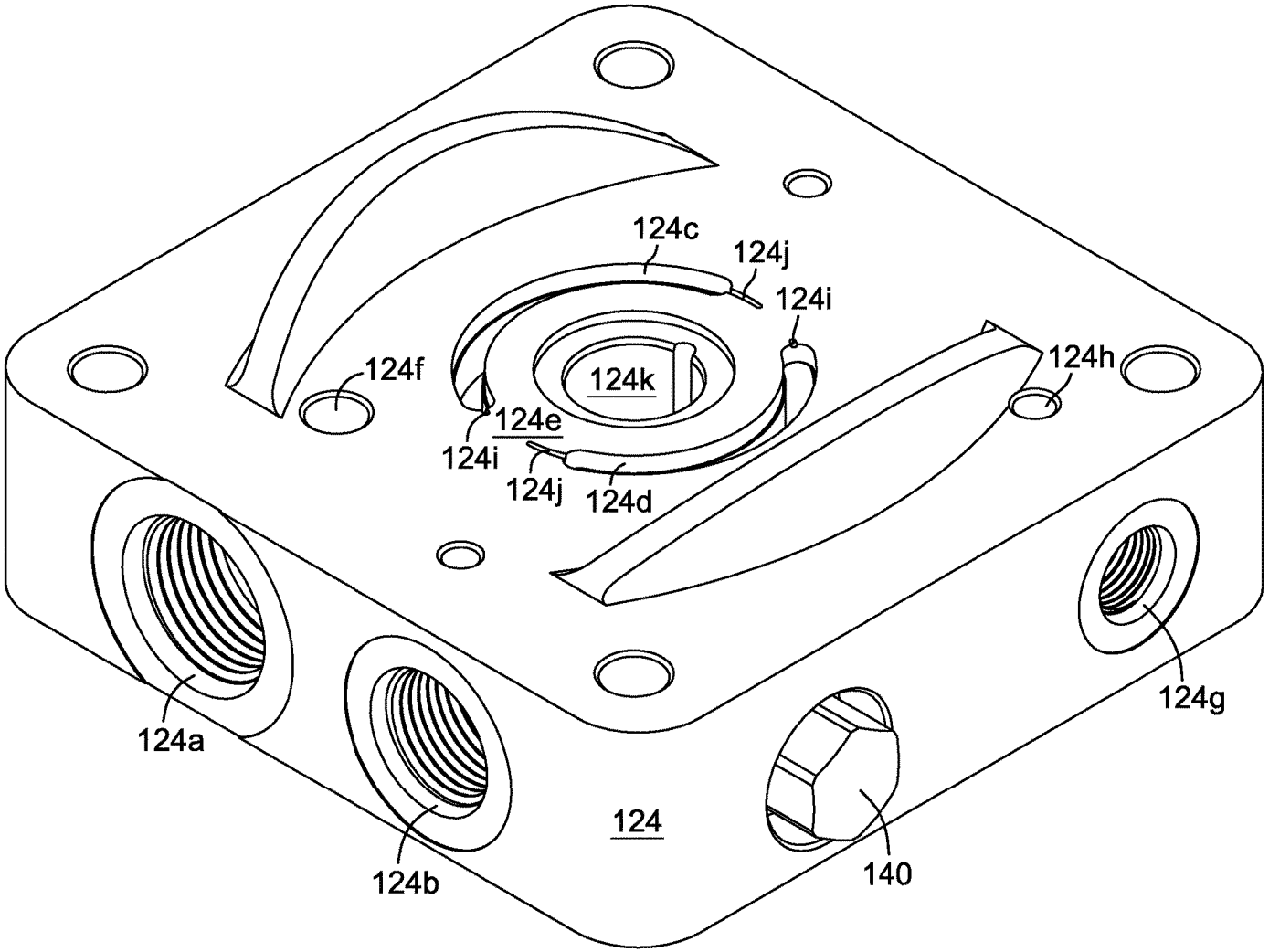
FIG. 2 is a perspective view of an end cap of the pump assembly of FIG. 1.
Figure 3:
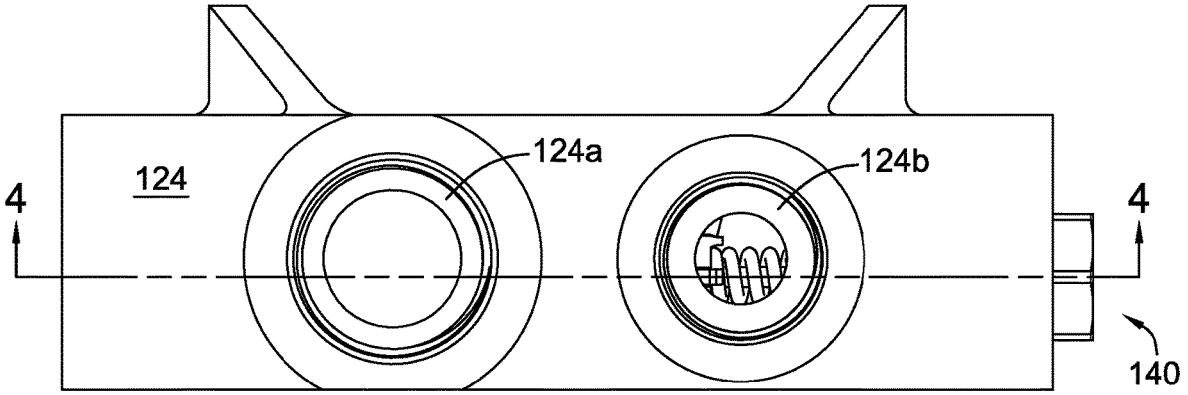
FIG. 3 is a side elevational view of the end cap of FIG. 2.
Figure 4:
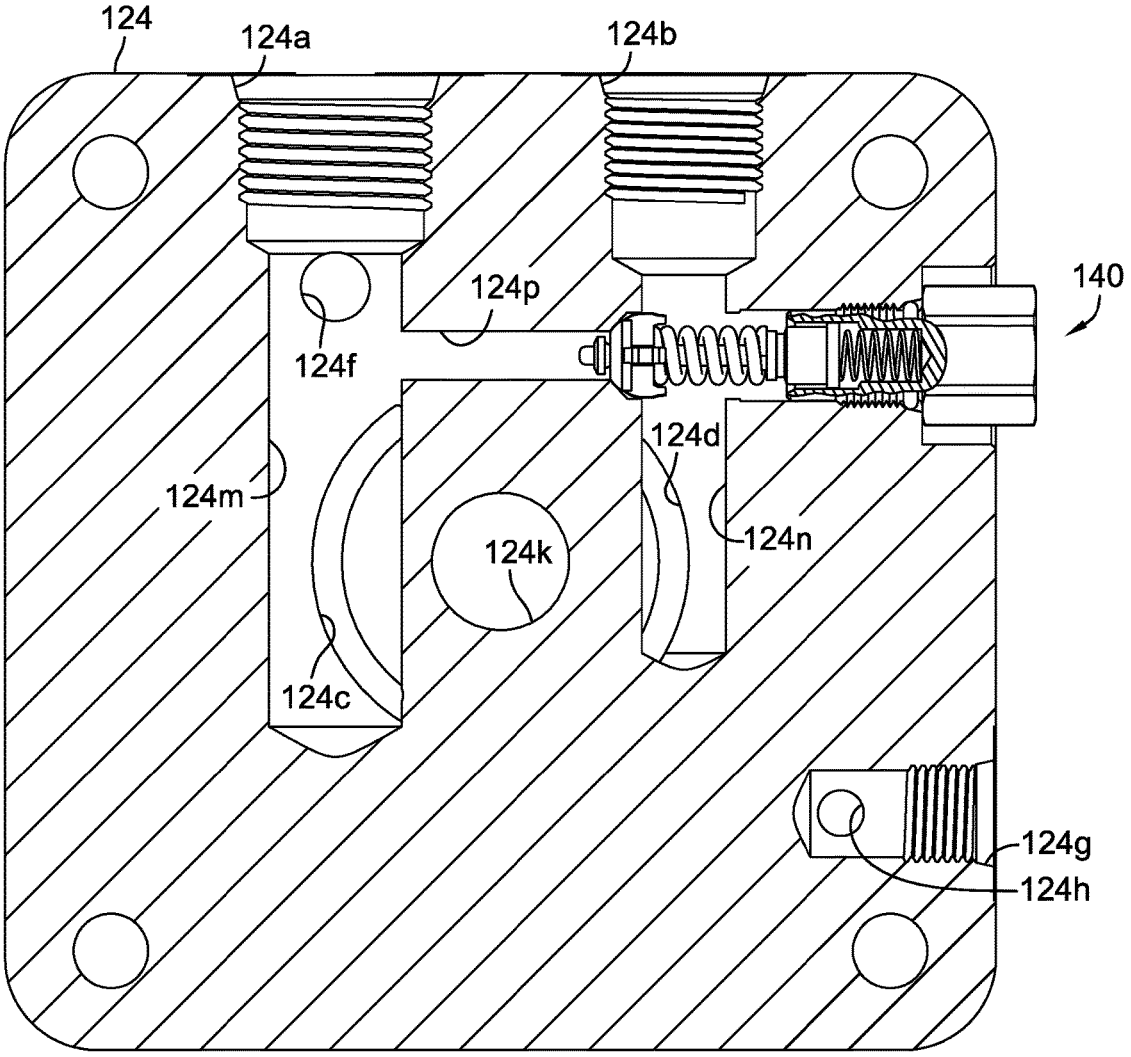
FIG. 4 is a cross-sectional view of the end cap of FIG. 3 along line 4-4 in FIG. 3.

Details of end cap 124 are shown in FIGS. 2-4. Inlet port 124*a* supplies fluid to the rotating cylinder block 122 of axial piston pump 120 via inlet passage 124*m* connected to the inlet kidney port 124*c* formed in running surface 124*e*. In the illustrated embodiment, cylinder block 122 is rotated clockwise by input shaft 121, the inner end of which is supported in a shaft support pocket or opening 124*k* formed in end cap 124. The shaft support pocket or opening 124*k* may include a bearing (not shown). A case drain passage 124*f* connects internal sump 170 to inlet passage 124*m* to relieve case pressure in pump assembly 115. Pistons 123 in the rotating cylinder block 122 move fluid from inlet kidney port 124*c* to the outlet kidney port 124*d* formed in running surface 124*e*. Fluid moves from outlet kidney port 124*d* to outlet port 124*b* via outlet passage 124*n*. Fluid pressure and flow between inlet passage 124*m* and outlet passage 124*n* via connecting passage 124*p* can be regulated by a combination check/relief valve assembly 140, which may be of the same design as that disclosed in commonly-owned U.S. Pat. No. 6,986,363, the terms of which are incorporated herein by reference. An air bleed passage 124*h* connects sump 170 to an air bleed port 124*g* which is used to bleed air from pump assembly 115 when filling pump assembly 115 with hydraulic fluid. In order to reduce the amplitude of pressure and flow pulsations in pump assembly 115 and thereby reduce noise, each kidney port 124*c*, 124*d* has a relatively short leading pressure gradient groove 124*i* and a longer trailing pressure gradient groove 124*j* formed therewith in the pump running surface 124*e*.

Figure 5:
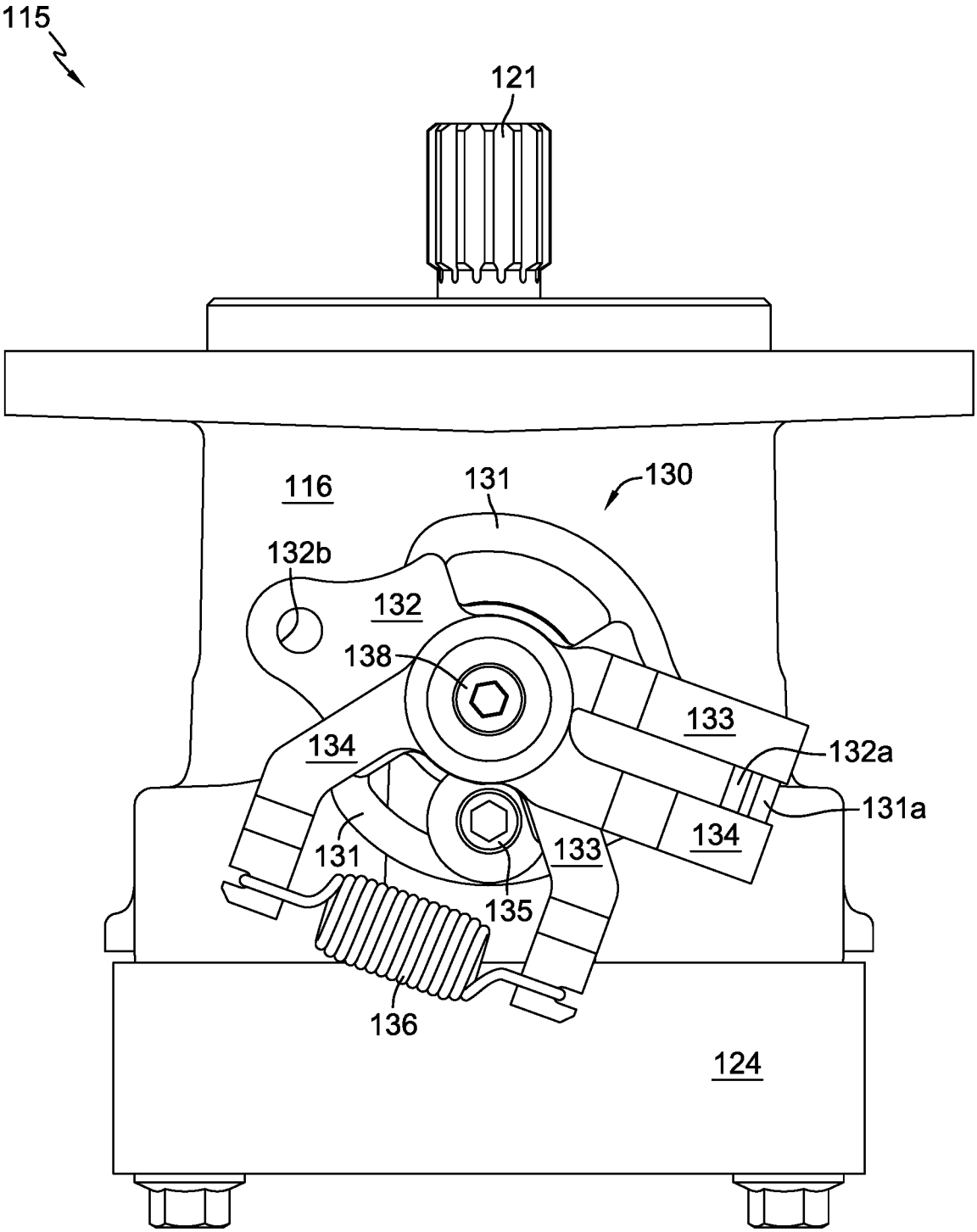
FIG. 5 is a side elevational view of the pump assembly of FIG. 1 with its fluid flow regulation mechanism shown in an initial, fully stroked to pressure set point position (biasing element unloaded).
Figure 6:
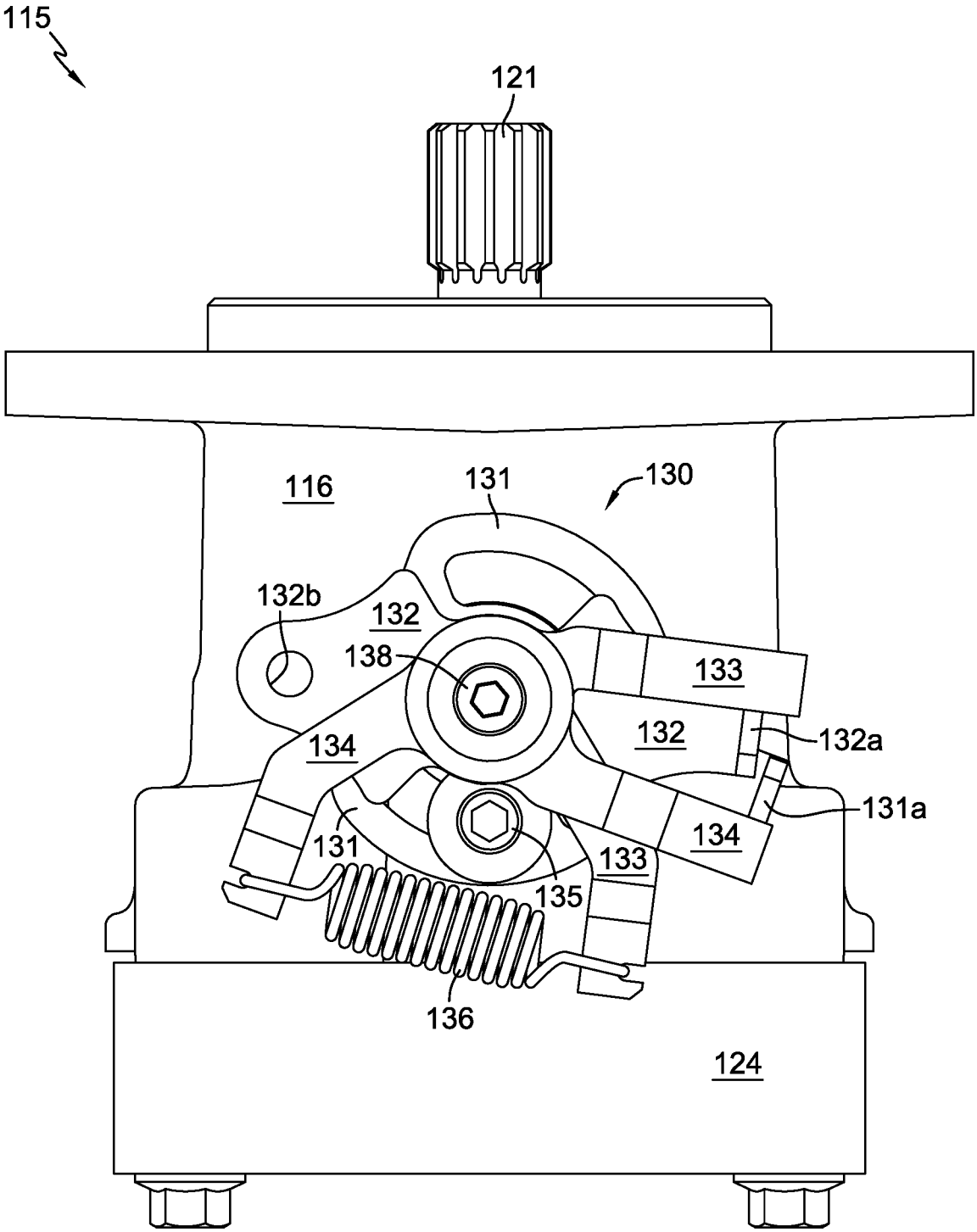
FIG. 6 is a side elevational view of the pump assembly of FIG. 1 with its fluid flow regulation mechanism shown in a partially de-stroked position (biasing element loaded).
Figure 7:
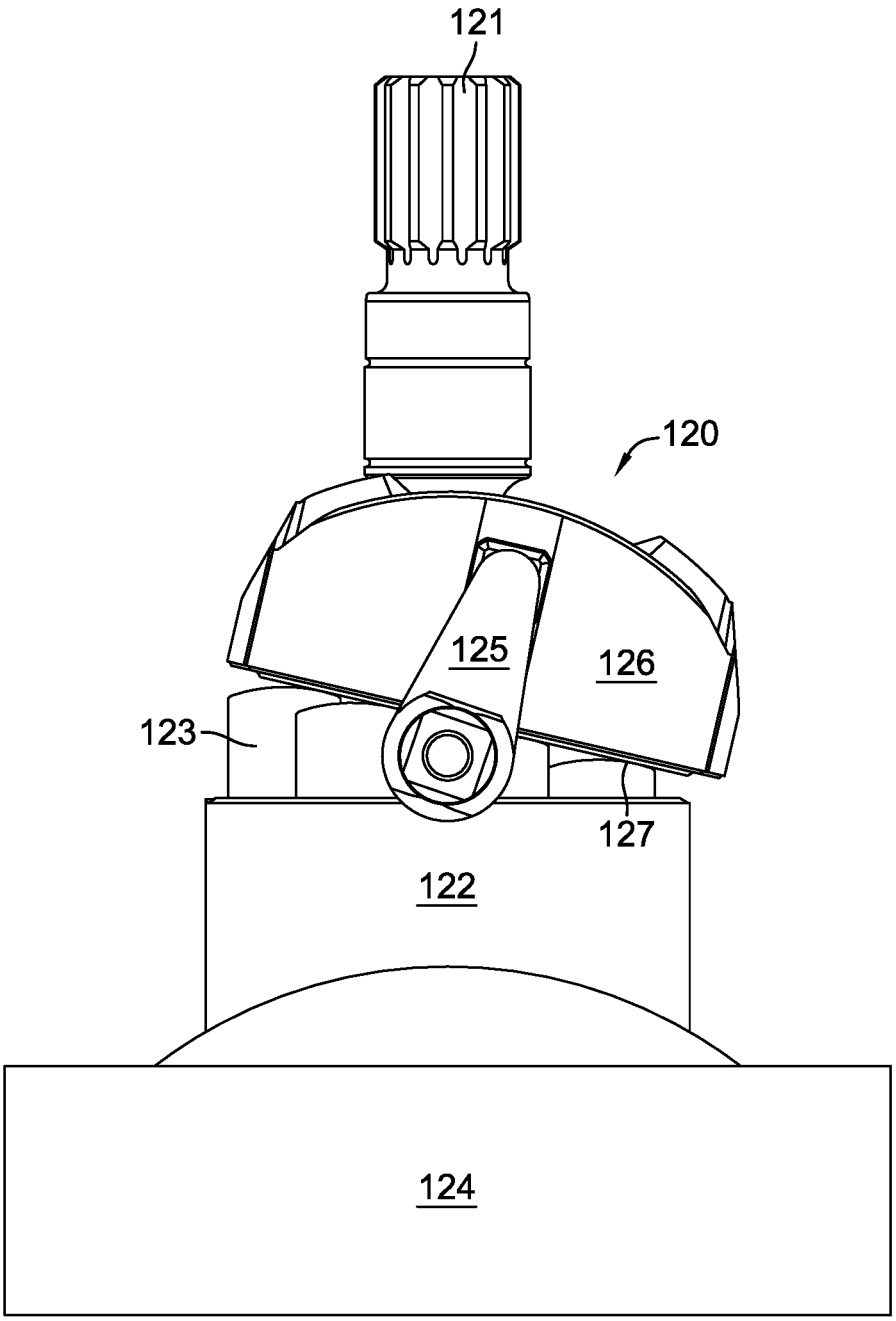
FIG. 7 is a side elevational view of the pump assembly of FIG. 5 with housing components removed to reveal basic components of the axial piston pump.
Figure 8:
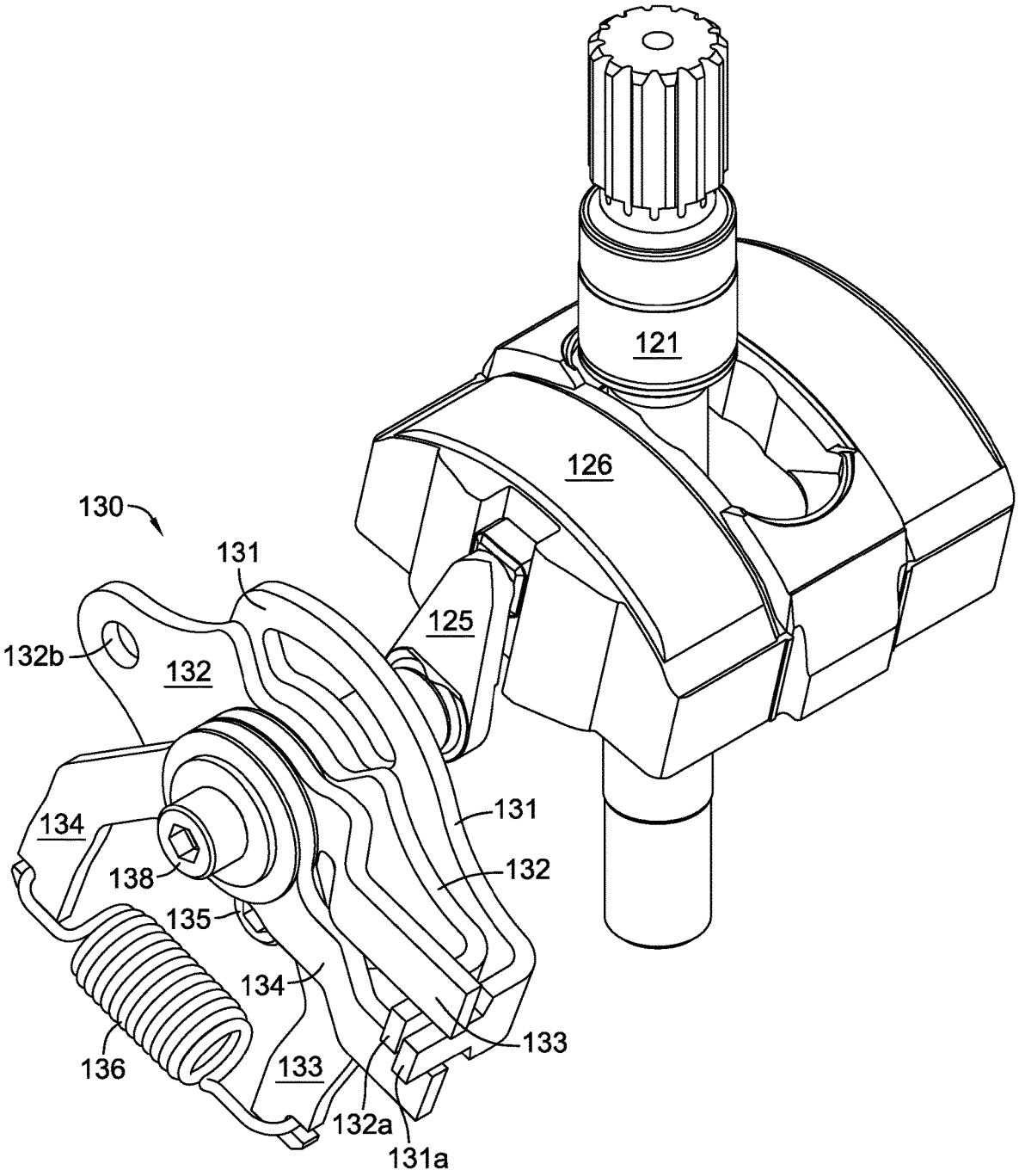
FIG. 8 is a perspective view of a portion of the pump assembly of FIG. 5.
Figure 9:
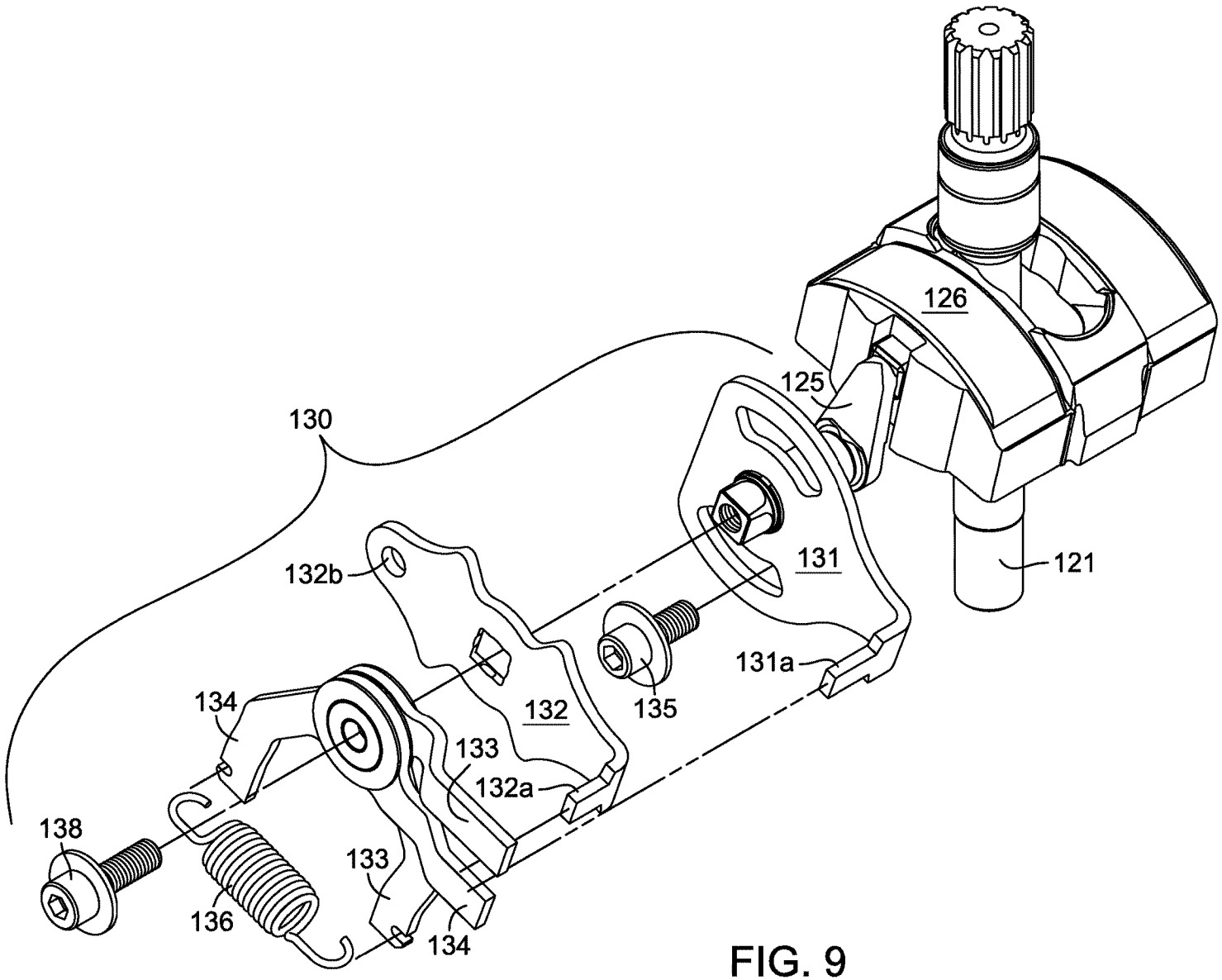
FIG. 9 is a partially exploded perspective view of the portion of the pump assembly shown in FIG. 8.

Return-to-stroke (RTS) mechanism 130 is set to an initial stroked position rather than at a hydraulic neutral position. RTS mechanism 130 allows swash plate 126 to approach a hydraulic neutral position or zero swash angle as system pressure increases, but it does not reach this neutral position (unless overloaded) to stop fluid flow. Also, swash plate 126 does not pass through this neutral position to reverse the direction of fluid flow as in a typical variable speed axial piston pump used in a vehicle ground drive system. Internal or external stops (not shown) may be added to pump assembly 115 to limit de-stroking of pump assembly 115, if needed. Or, a relief valve may be used to relieve excessive pressure in the hydraulic system. As shown in FIGS. 5 and 7, swash plate 126 is positioned at an appropriate angle or pressure set point as determined for a particular application based on system fluid pressure and flow parameters.

RTS mechanism 130 is attached to trunnion arm 125 by means of a fastener 138. RTS 130, along with trunnion arm 125 and swash plate 126, is then rotated to the desired set point (or swash plate angle) and locked in place by lockdown screw 135. Specifically, lockdown screw 135 is engaged to housing 116 and torqued to secure a stroke set plate 131 in position, thereby setting the maximum stroke of axial piston pump 120. The stroke set plate 131 has a contact member or return tab 131*a* against which a rotatable inner arm 133 and a rotatable outer arm 134 are biased by a tension spring 136 that is connected to both inner arm 133 and outer arm 134.

At low system pressures, swash plate 126 remains at the set maximum stroke (and maximum flow) position. As hydraulic work load increases, pressure in the pistons 123 of pump 120 increases (via outlet port 124*b*). When this pressure increases enough to overcome the bias of tension spring 136, swash plate 126 begins to rotate away from the pressure set point and towards hydraulic neutral. A projection 132*a* of controlled arm 132, positioned between inner arm 133 and outer arm 134, bears against inner arm 133, thereby causing inner arm 133 to rotate. This rotation of inner arm 133 while outer arm 134 bears against the return tab 131*a* and does not rotate, causes stretching and increased tension of spring 136. Tension spring 136 allows pump 120 to de-stroke, thereby reducing pump output (fluid flow) based on the increase in demand for fluid pressure (from a vehicle auxiliary function, for example). Then, if fluid pressure demand drops, pump 120 will stroke back towards the pressure set point. When the pressure set point is reached, pump 120 can again de-stroke towards the hydraulic neutral point, thereby reducing fluid flow and limiting the input power demand of pump 120.

Generally, the spring rate of tension spring 136 determines the response of pump 120 to an increase in pressure demand. In addition to the adjustable pressure (or swash angle) set point of RTS 130, the ability to specify various spring rates for tension spring 136 affords versatility in tailoring pump assembly 115 to meet the requirements of various applications.

RTS mechanism 130 can limit the maximum input power drawn from a prime mover as system pressure increases. Generally, a stiffer tension spring 136 requires greater system pressure and input power to stroke pump assembly 115 towards neutral than does a tension spring 136 of lesser stiffness. At any given swash angle (above zero degrees) of swash plate 126, system pressure is higher and the associated input power requirement is higher when using a heavy spring 136 versus a light spring 136. A light tension spring 136 will allow the pump assembly 115 to de-stroke from any given swash plate angle set point at a lower system pressure demand (and sooner) than will a heavy tension spring 136, and will therefore require less input power as pump assembly 115 is de-stroked from the swash plate angle set point.

Whereas the "control arm" of a typical variable speed axial piston pump is normally operator-controlled via linkage or electric actuator attached to the control arm, the "controlled arm" 132 of pump assembly 115 is moved or controlled by the fluid pressure fluctuations of pump 120 and is not controlled via linkage or electric actuator. The controlled arm 132 may include an adjustment and/or attachment feature such as opening 132*b* (or alternatively, a pin, post, tab, slot, etc.) to aid in setting the desired pressure set point or to attach a driven linkage, for example. Since the controlled arm 132 is driven by fluid pressure fluctuations and is directly correlated with the angle of swash plate 126, controlled arm 132 could be used to drive, actuate, activate or facilitate a variety of derivative functions. By way of examples, the moving controlled arm 132 could directly (by contact) or indirectly (via linkage) actuate a hydraulic bypass, or a fail-safe function, or provide operator feedback when a specified swash plate angle is attained or when the swash plate angle is positioned within a certain range. If, for example, a biasing spring 136 of RTS 130 were to break during operation of pump assembly 115, swash plate 126 could move beyond its normal operating range. This extra movement of swash plate 126 could cause controlled arm 132 to come into contact with a switch or valve actuator to initiate safe shutdown of a vehicle or disable a function of a vehicle.

Figure 10:
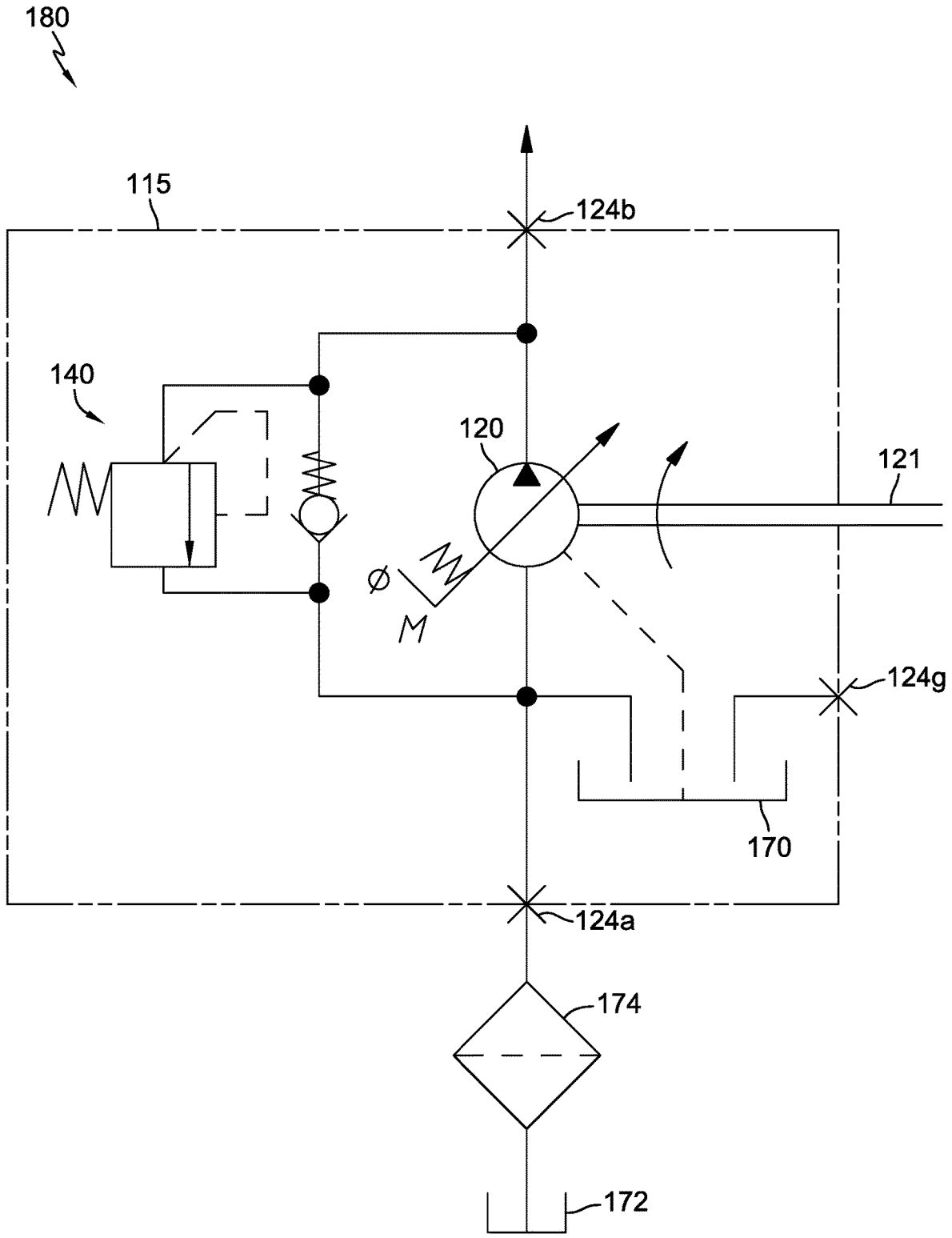
FIG. 10 is a schematic diagram of an open hydraulic circuit including the pressure compensating pump assembly of FIG. 1.

An open hydraulic circuit 180, including the previously described pressure compensating pump assembly 115, is schematically depicted in FIG. 10. Fluid is drawn from a reservoir 172 through a filter 174 and into the inlet port 124*a* of pump assembly 115.

Figure 14:
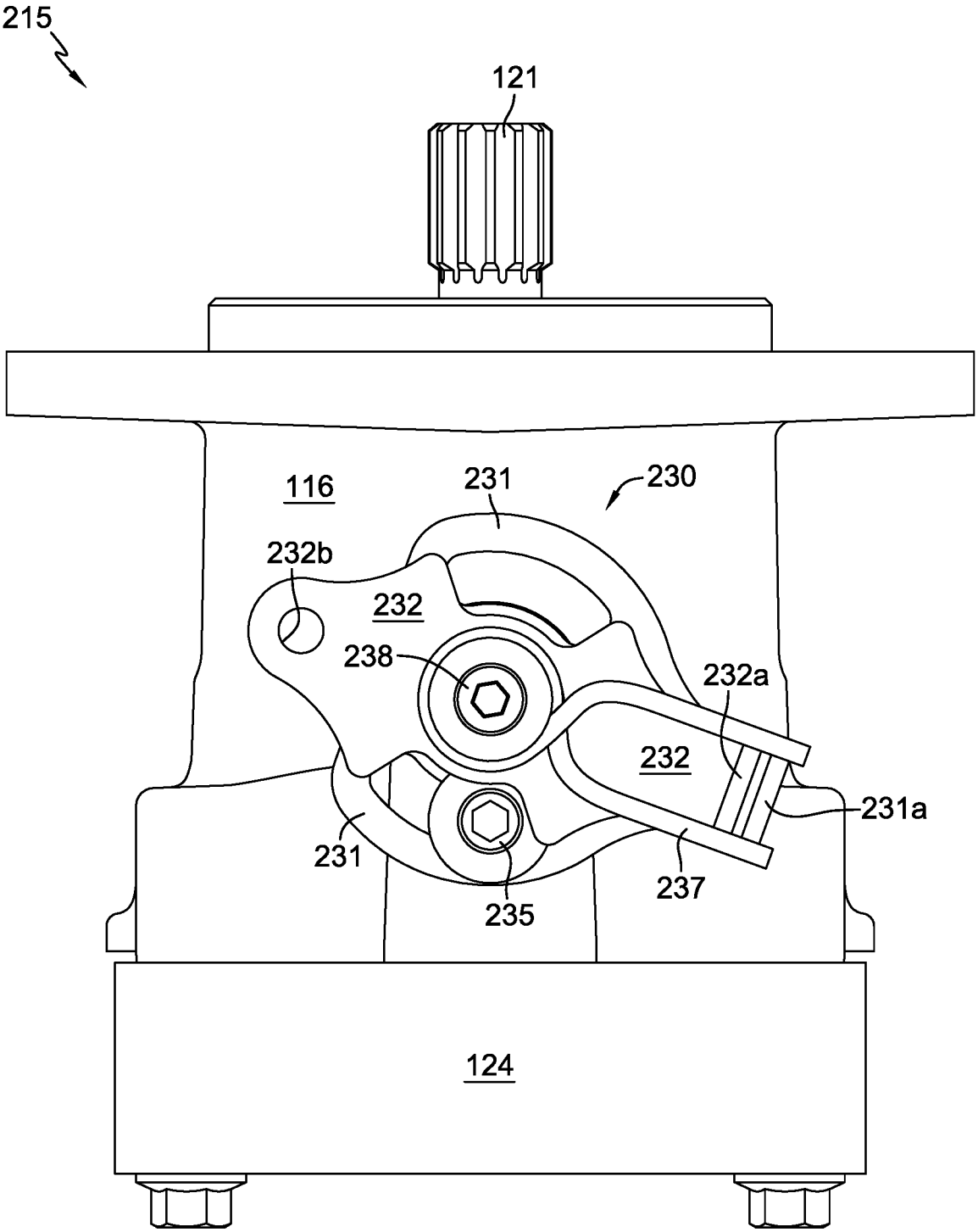
FIG. 14 is a side elevational view of a further embodiment of a pressure compensating pump.

A second embodiment of a pressure compensating pump assembly 215 is shown in FIG. 14. Item number "215" could be substituted for item number "115" in FIG. 10, as pump assembly 215 is schematically and structurally equivalent to pump assembly 115, with the exception of return-to-stroke mechanism 230. RTS 230 has a torsion spring 237 that replaces the inner arm 133, the outer arm 134 and the tension spring 136 of RTS 130. RTS 230 operates in a manner approximately equivalent to RTS 130 as will be understood by one of skill in the art. However, use of the torsion spring 237 provides a more linear response to pressure demands while reducing the part count and cost of pump assembly 215.

Figure 11:
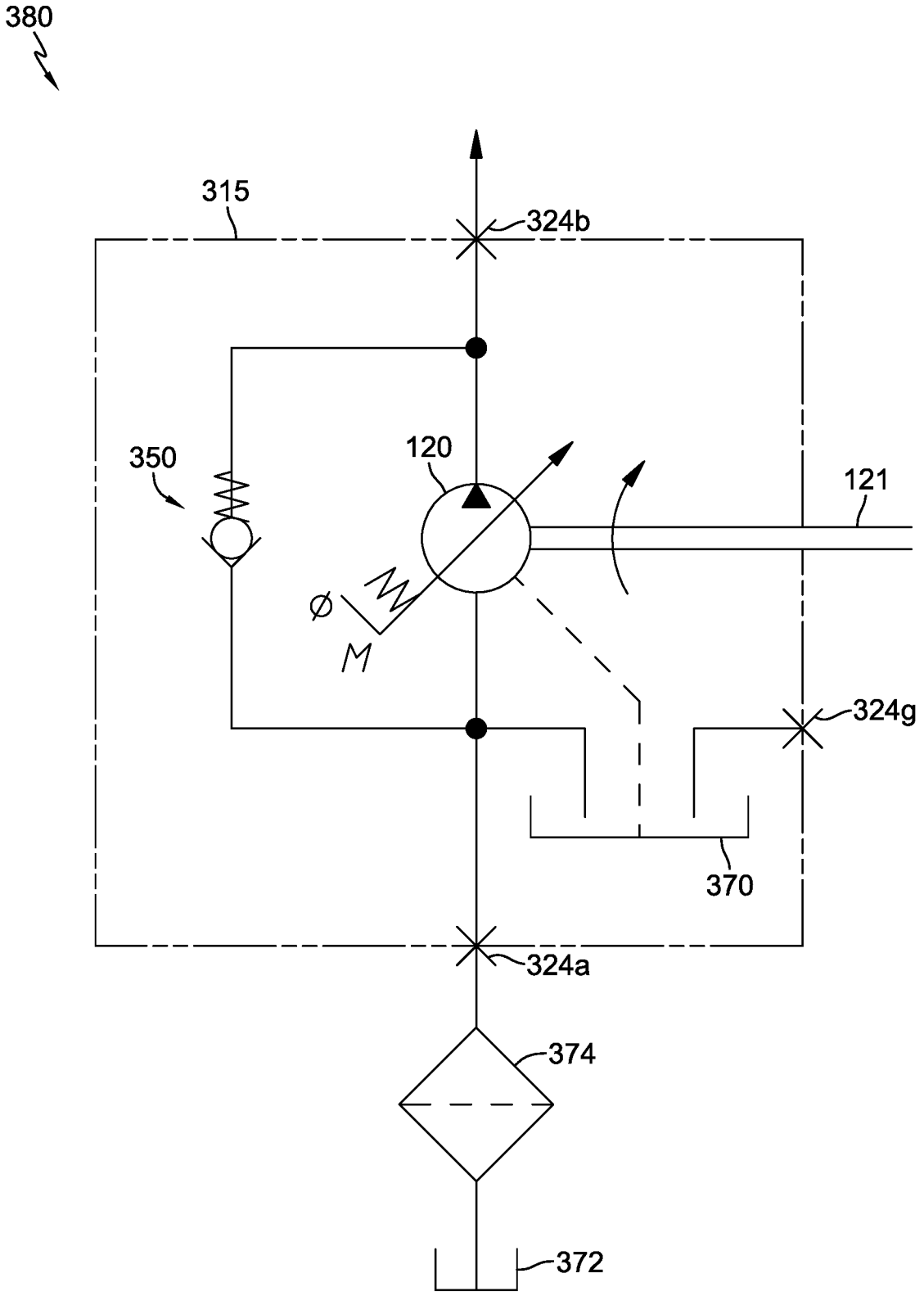
FIG. 11 is a schematic diagram of an open hydraulic circuit including another embodiment of the present application.

An open hydraulic circuit 380 is schematically depicted in FIG. 11. Hydraulic circuit 380 is the same as hydraulic circuit 180, with the exception of a simple check valve 350 in lieu of combination check/relief valve 140.

Figure 12:
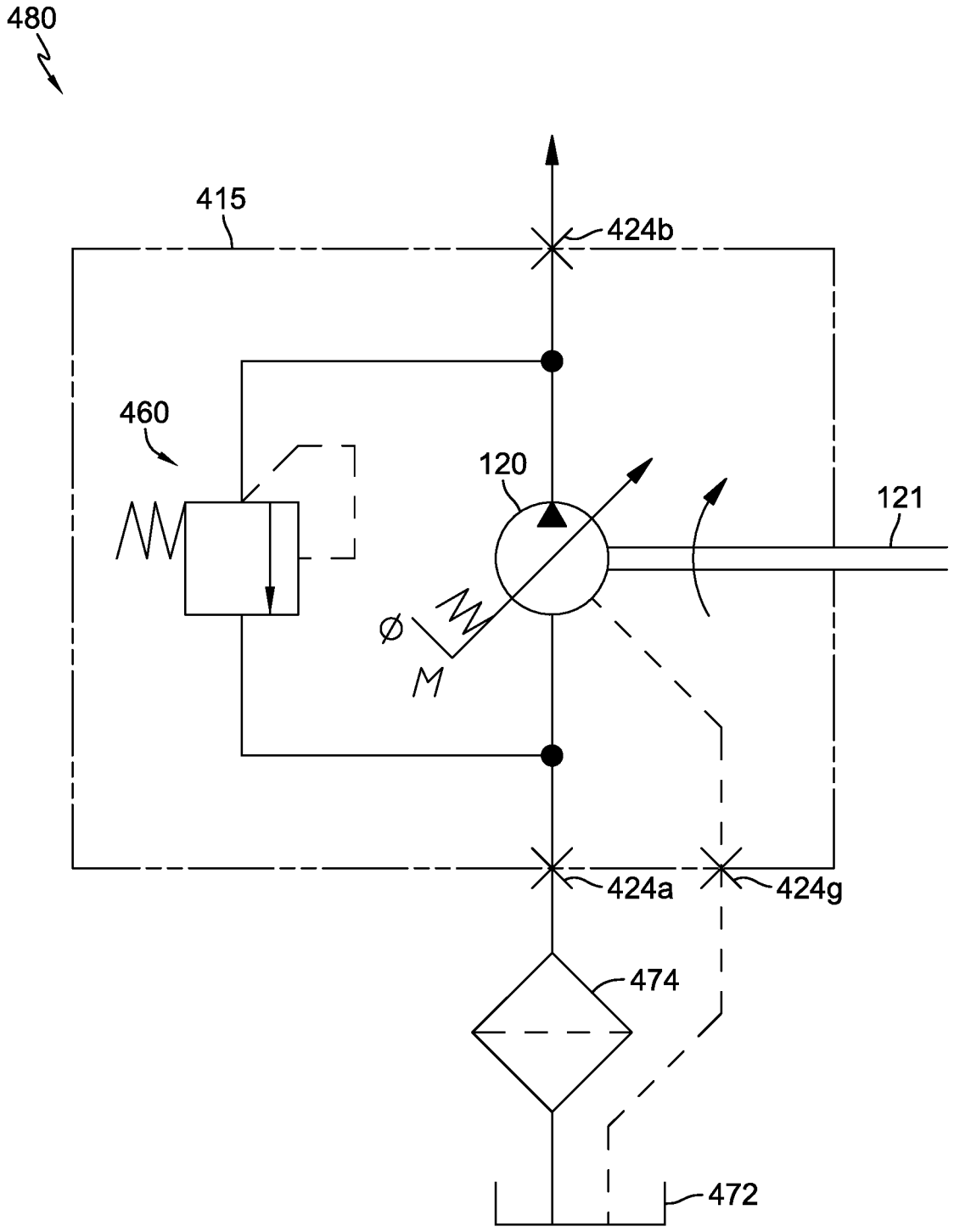
FIG. 12 is a schematic diagram of an open hydraulic circuit including yet another embodiment of the present application.

Another open hydraulic circuit 480 is schematically depicted in FIG. 12. Hydraulic circuit 480 indicates the optional use of air bleed port 124*g* as a case drain port 424*g* connected to external reservoir 472, and use of a pressure relief valve 460 in lieu of a check valve or combination check/relief valve.

Figure 13:
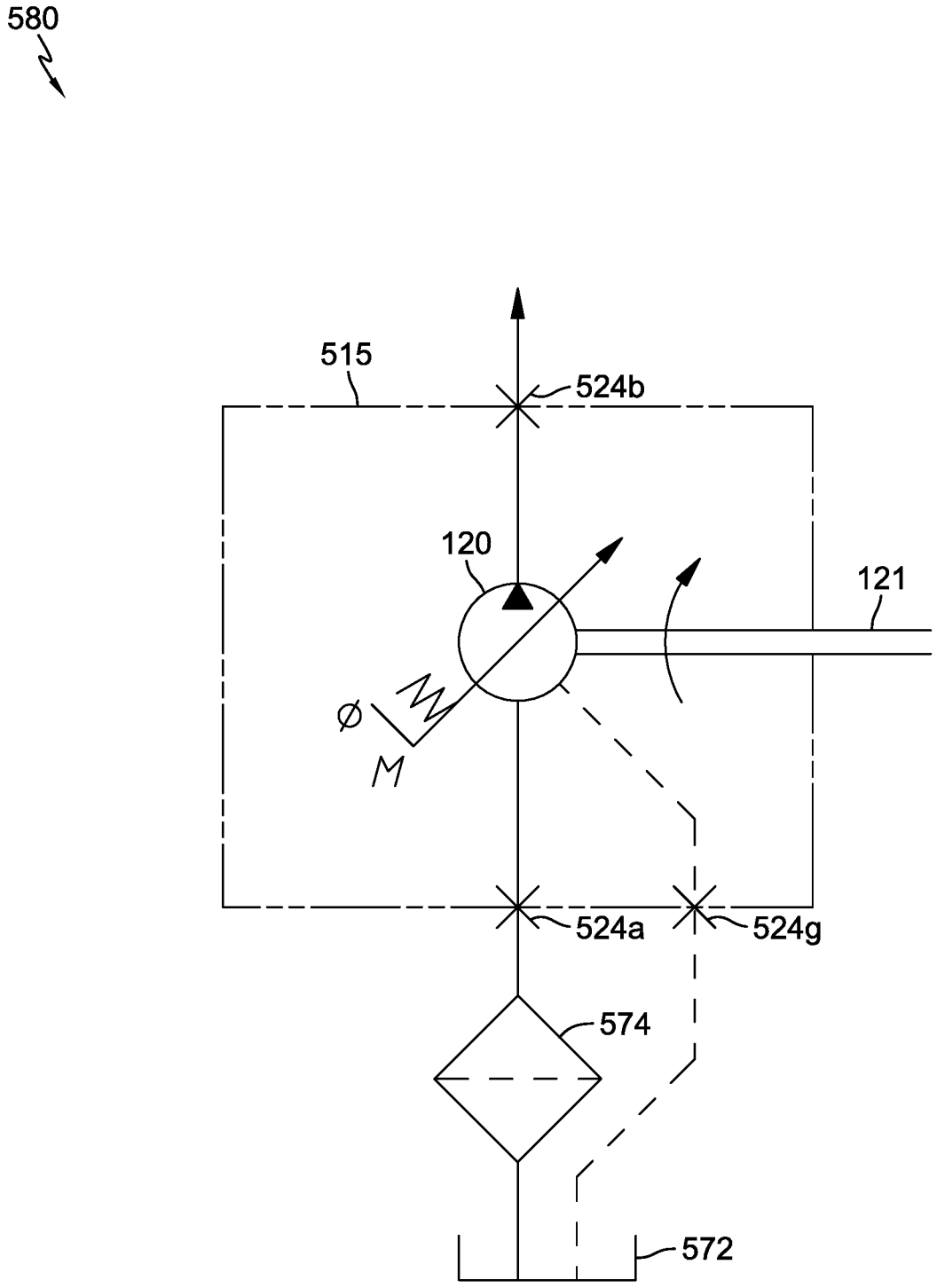
FIG. 13 is a schematic diagram of an open hydraulic circuit including still another embodiment of the present application.

Yet another open hydraulic circuit 580 is schematically depicted in FIG. 13. Hydraulic circuit 580 is the same as hydraulic circuit 480, except use of a valve is not indicated.

Selection of biasing means, valve type or valve omission, and case drain use, may be based on cost considerations, functionality requirements and the specific application of a pressure compensating pump assembly 115, 215, 315, 415, 515.

Figure 15:
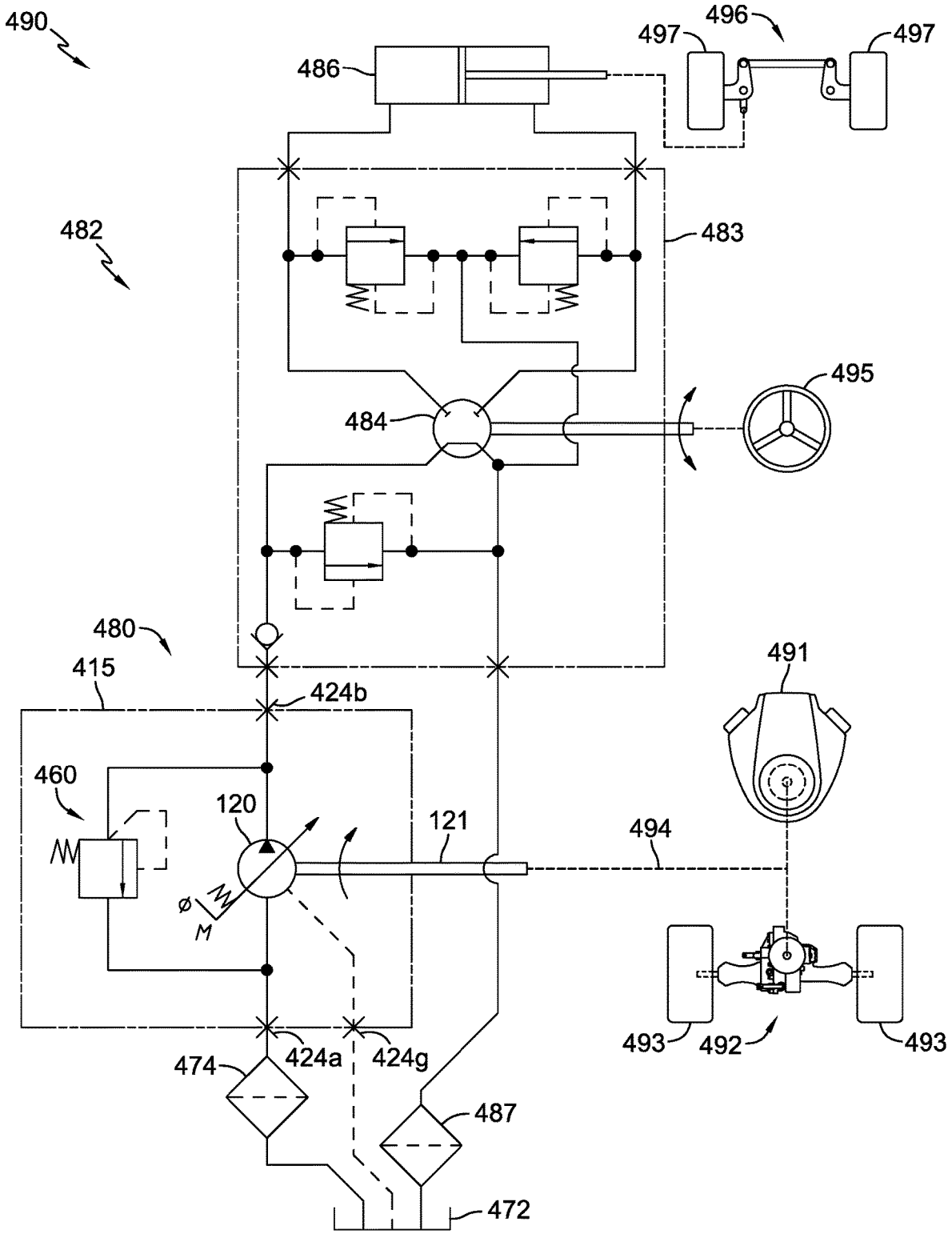
FIG. 15 is a schematic diagram of a hydraulic power steering circuit including the pressure compensating pump assembly of FIG. 12.

One application of a pressure compensating pump such as that disclosed herein is shown in FIG. 15, wherein pressure compensating pump assembly 415 is used in a hydraulic power steering system 482. Hydraulic power steering system 482 comprises hydraulic circuit 480 (described previously herein), a hydraulic steering unit 483, and at least one hydraulic steering cylinder 486. Hydraulic power steering system 482 may be part of a vehicle drive and steering system 490 comprising a prime mover 491 powering a ground drive 492 to drive at least one driven wheel 493 and also powering pressure compensating pump assembly 415 via conventional belt and pulley system 494 or other known power transfer means. Vehicle drive and steering system 490 further comprises a steering input device 495 (which may be a conventional steering wheel, as shown) for operator control of the hydraulic steering unit 483 that includes a steering control valve and metering pump 484. Vehicle drive and steering system 490 also includes a steering linkage 496 connecting the hydraulic steering cylinder(s) 486 to at least one steered wheel 497. It should be noted that steering input device 495 is not limited to a conventional steering wheel and may include other steering input devices, such as an electric rotary actuator, for example. Steering input device 495 may be powered manually, electrically (including wirelessly) or hydraulically.

Pressure compensating pump assembly 415 supplies power steering fluid to the steering control valve and metering pump 484 of the hydraulic steering unit 483 to actuate hydraulic steering cylinder(s) 486 to steer via steering linkage 496 at least one steered wheel 497 of the vehicle drive and steering system 490. Power steering fluid is returned from hydraulic steering unit 483 to external reservoir 472 through a fine-particle filter 487. Various hydraulic steering units that can be used with a pressure compensating pump assembly such as pump assembly 415 are commercially available. One example of such a hydraulic steering unit is type OSPM, available from the Danfoss Group. A type OSPM unit may be used in utility vehicles such as lawn mowers and garden tractors.

While specific embodiments have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A pressure compensating pump for use with an auxiliary hydraulic system, the pressure compensating pump comprising:

a housing comprising:

an axial piston pump mounted therein, wherein the axial piston pump receives hydraulic fluid from a sump through an inlet and provides hydraulic fluid under pressure to the auxiliary hydraulic system through an outlet, and an end cap on which the axial piston pump is mounted, the end cap comprising the inlet and the outlet and porting formed therein for hydraulic fluid flow, and wherein the hydraulic fluid flow through the porting is unidirectional, and a pair of kidney ports connected to the porting, each kidney port having a leading pressure gradient groove and a trailing pressure gradient groove, wherein the trailing pressure gradient groove of each kidney port is longer than the leading pressure gradient groove of the same kidney port;

a moveable swash plate engaged to the axial piston pump;

a rotatable shaft coupled to the moveable swash plate and extending from the housing; and a fluid flow regulation mechanism disposed external to the housing and comprising:

a controlled arm attached to the rotatable shaft to rotate therewith;

a stroke set plate comprising at least one contact member, the stroke set plate being secured to an external surface of the housing in a position wherein the at least one contact member limits the rotation of the controlled arm to set a stroke limit position of the axial piston pump, wherein the stroke limit position corresponds to a non-neutral position of the axial piston pump; and a biasing member engaged to the controlled arm, wherein the biasing member allows the controlled arm to rotate and the axial piston pump to de-stroke in response to an increase in demand for fluid pressure by the auxiliary hydraulic system through the outlet, and the biasing member biases the controlled arm to return to the stroke limit position.

2. The pressure compensating pump of claim 1, wherein the fluid flow regulation mechanism further comprises a first arm and a second arm and the biasing member is engaged to both the first arm and the second arm, and the increase in demand for fluid pressure causes one of either the first arm or the second arm to be rotated under tension away from the stroke set plate by the controlled arm.

3. The pressure compensating pump of claim 2, wherein the biasing member is a tension spring having a spring rate that influences the fluid pressure and fluid flow generated by the axial piston pump in response to fluid pressure demand.

4. The pressure compensating pump of claim 1, wherein the biasing member is a torsion spring having a spring rate that influences the fluid pressure and fluid flow generated by the axial piston pump in response to fluid pressure demand.

5. The pressure compensating pump of claim 1, wherein the fluid flow regulation mechanism further comprises a first arm and a second arm biased against the stroke set plate by the biasing member, and the increase in demand for fluid pressure causes one of either the first arm or the second arm to be rotated under tension away from the stroke set plate by the controlled arm.

6. The pressure compensating pump of claim 1, wherein a stroke limit of the axial piston pump corresponds to an adjustable pressure set point determined by the position of the stroke set plate when it is secured to the housing.

7. The pressure compensating pump of claim 1, wherein the controlled arm is rotated through an angular range defined by an adjustable pressure set point and another point greater than hydraulic neutral in response to changes in fluid pressure demand.

8. A pressure compensating pump for use with an auxiliary hydraulic system, the pressure compensating pump comprising:

a housing comprising a main housing member and an end cap joined thereto to form an internal sump, the end cap comprising an inlet connected to an external sump, an outlet connected to the auxiliary hydraulic system, porting formed therein for unidirectional hydraulic fluid flow, a running surface, a pair of kidney ports formed on the running surface and connected to the porting, each kidney port having a leading pressure gradient groove and a trailing pressure gradient groove, wherein the trailing pressure gradient groove of each kidney port is longer than the leading pressure gradient groove of the same kidney port;

an axial piston pump mounted in the internal sump, wherein the axial piston pump receives hydraulic fluid from the external sump through the inlet and provides hydraulic fluid under pressure to the auxiliary hydraulic system through the outlet;

a moveable swash plate engaged to the axial piston pump;

a rotatable shaft having a first end disposed inside the housing and coupled to the moveable swash plate and a second end disposed external to the housing; and a controlled arm mounted external to the housing and attached to the second end of the rotatable shaft to rotate therewith;

a stroke set plate comprising at least one contact member, the stroke set plate being secured to an external surface of the housing in a position wherein the at least one contact member limits the rotation of the controlled arm to set a stroke limit position of the axial piston pump, wherein the stroke limit position corresponds to a non-neutral position of the axial piston pump; and a spring disposed external to the housing and engaged to the controlled arm, wherein the spring allows the controlled arm to rotate and the axial piston pump to de-stroke in response to an increase in demand for fluid pressure by the auxiliary hydraulic system through the outlet, and the spring biases the controlled arm to return to the stroke limit position.

9. A pressure compensating pump for use in a hydraulic system having a hydraulic porting system for hydraulic fluid, a prime mover, a primary hydraulic system connected to the hydraulic porting system and an auxiliary unit, the pressure compensating pump comprising:

an inlet connected to the hydraulic porting system for receiving hydraulic fluid;

an outlet connected to the auxiliary unit for providing hydraulic fluid to the auxiliary unit;

an end cap comprising a running surface and a pair of kidney ports connected to the hydraulic porting system, each kidney port having a leading pressure gradient groove and a trailing pressure gradient groove, wherein the trailing pressure gradient groove of each kidney port is longer than the leading pressure gradient groove of the same kidney port;

an axial piston pump mounted on the running surface and hydraulically connected to the inlet and the outlet;

a moveable swash plate engaged to the axial piston pump for altering an output of hydraulic fluid therefrom;

a rotatable shaft coupled to the moveable swash plate and extending therefrom; and a fluid flow regulation mechanism comprising:

a controlled arm attached to the rotatable shaft to rotate therewith, wherein the controlled arm is rotated through an angular range defined by an adjustable pressure set point and another point greater than hydraulic neutral in response to changes in fluid pressure demand;

a stroke set plate comprising at least one contact member, the stroke set plate being secured to the pressure compensating pump in a position wherein the at least one contact member limits the rotation of the controlled arm to set a stroke limit position of the axial piston pump, wherein the stroke limit position corresponds to a non-neutral position of the axial piston pump;

a biasing member engaged to the controlled arm, wherein the biasing member allows the controlled arm to rotate and the axial piston pump to de-stroke in response to an increase in demand for fluid pressure by the auxiliary unit through the outlet, and the biasing member biases the controlled arm to return to the stroke limit position.

10. The pressure compensating pump of claim 9, wherein the biasing member is a tension spring having a spring rate that influences the fluid pressure and fluid flow generated by the axial piston pump in response to fluid pressure demand.

11. The pressure compensating pump of claim 9, wherein the biasing member is a torsion spring having a spring rate that influences the fluid pressure and fluid flow generated by the axial piston pump in response to fluid pressure demand.

12. The pressure compensating pump of claim 9, wherein the end cap comprises the inlet and the outlet and porting formed therein for hydraulic fluid flow, and wherein the hydraulic fluid flow through the porting is unidirectional.

13. The pressure compensating pump of claim 12, wherein the fluid flow regulation mechanism further comprises a first arm and a second arm biased against the stroke set plate by the biasing member, and the increase in demand for fluid pressure causes one of either the first arm or the second arm to be rotated under tension away from the stroke set plate by the controlled arm.

14. The pressure compensating pump of claim 9, wherein a stroke limit of the axial piston pump corresponds to the adjustable pressure set point determined by the position of the stroke set plate.

* * * * *